US005674804A

United States Patent [19]

Steen et al.

[11] Patent Number: 5,674,804

[45] Date of Patent: Oct. 7, 1997

[54] DYE DONOR ELEMENT FOR USE IN THERMAL DYE TRANSFER PRINTING

[75] Inventors: Luc Van Steen, Antwerpen; Marc Mannens, Kessel, both of Belgium

[73] Assignee: Agfa-Gevaert N.V., Mortsel, Belgium

[21] Appl. No.: 548,295

[22] Filed: Nov. 1, 1995

[30] Foreign Application Priority Data

Nov. 4, 1994 [EP] European Pat. Off. ..... 94203204

[51] Int. Cl.[6] ..... B41M 5/035; B41M 5/38

[52] U.S. Cl. ..... 503/227; 428/195; 428/323; 428/331; 428/341; 428/342; 428/913; 428/914

[58] Field of Search ..... 8/471; 428/195, 428/207, 331, 913, 914, 323, 341, 342; 503/227

[56] References Cited

U.S. PATENT DOCUMENTS

| | | | |
|---|---|---|---|
| 4,968,659 | 11/1990 | Noshitani | 503/227 |
| 5,300,476 | 4/1994 | Kubodera et al. | 503/227 |
| 5,374,602 | 12/1994 | DeFieuw et al. | 503/227 |

FOREIGN PATENT DOCUMENTS

| | | | |
|---|---|---|---|
| 0227092 | 7/1987 | European Pat. Off. | 503/227 |
| 0573080 | 12/1993 | European Pat. Off. | 503/227 |
| 2150310 | 6/1985 | United Kingdom | 503/227 |

*Primary Examiner*—Bruce H. Hess

*Attorney, Agent, or Firm*—Brumbaugh, Graves, Donohue & Raymond

[57] ABSTRACT

The present invention discloses a dye-donor element for use according to dye diffusion thermal transfer printing comprising on one side of a support a heat-resistant layer and on a side of the support opposite thereto a donor layer comprising a dye, a binder and a surfactant, said surfactant being a copolymer corresponding to the general formula (I)

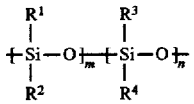

(I)

wherein $R^1$, $R^2$ and $R^3$ each independently represent an alkyl group $R^4$ represents an aralkyl group m and n represent the molar fractions of the respective units in the copolymer and have a value of 0.01 to 0.99 with the provision that the sum of m and n equals 1.

10 Claims, No Drawings

DYE DONOR ELEMENT FOR USE IN THERMAL DYE TRANSFER PRINTING

FIELD OF THE INVENTION

The present invention relates to dye donor elements for use according to thermal dye sublimation transfer. More in particular the present invention relates to a dye donor element for obtaining an improved image quality.

BACKGROUND OF THE INVENTION

Thermal dye transfer methods include thermal dye sublimation transfer also called dye diffusion thermal transfer. This is a recording method in which a dye-donor element provided with a dye layer containing sublimating dyes having heat transferability is brought into contact with an image receiver sheet and selectively, in accordance with a pattern information signal, heated with a thermal printing head provided with a plurality of juxtaposed heat-generating resistors, whereby dye is transferred from the selectively heated regions of the dye-donor element to the image receiver sheet and forms a pattern thereon, the shape and density of which are in accordance with the pattern and intensity of heat applied to the dye-donor element. In order to obtain a full colour print, the image receiving sheet is printed three times with a yellow, magenta and cyan area of the dye-donor element. Monochrome images can be obtained by using a dye-donor element comprising a yellow, a magenta and a cyan area or by using a monochrome donor element whereby the dye layer comprises a black dye or a black mixture of coloured dyes.

A dye-donor element for use according to thermal dye sublimation transfer usually comprises a very thin support e.g. a polyester support, one side of which is covered with a dye layer comprising the printing dyes in a form that can be released in varying amounts depending on how much heat is applied to the dye-donor element.

The dye in the dye layer is usually dissolved or dispersed in a binder. Known binder resins are cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, and cellulose triacetate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; copolymers of styrene and acrylonitrile; polysulfones; polyphenylene oxide; organosilicones such as polysiloxanes; epoxy resins and natural resins, such as gum arabic.

The dye layer comprising dye(s) dissolved or dispersed in a binder may be coated from a solution in appropriate solvents on the subbed support, but the known coating techniques are not quite adapted to the discontinuous coating of differently coloured dye areas on a thin support. It is therefore customary, especially in large-scale manufacturing conditions, to print the dye layer on a support by printing techniques such as a gravure process.

The homogenity of the casted dye layer determines the homogenity and image quality of the image after image-wise heating. It is known to use surfactants to improve the casting behaviour of the coating solution. However, known surfactants such as fluor surfactants, such as e.g. Fluorad FC 430, a fluor surfactant manufactured by 3M as used in U.S. Pat. No. 5,252,534 and Dow Corning 510 (polydimethylsiloxane) as used in U.S. Pat. No. 4,772,582 perform not sufficient to reach a high uniformity of the coating. Especially pinholes, caused by poor wetting of the support or the subbing layer, remain a problem. These pinholes in the dye layer of the dye donor element give rise to image defects in the printed image. This problem arises especially when particles, such as e.g. polymethylsilylsesquioxane particles, protruding from the surface of the donor element, are added to the coating solution of the dye layer and/or when butanone is used as a coating liquid.

SUMMARY OF THE INVENTION

It is therefore an object of the present invention to provide dye donor elements not having the disadvantages mentioned above. It is a further object of the invention to provide a method to obtain a high quality image by means of dye diffusion transfer printing. Further objects will become apparent from the description hereinafter.

According to the present invention there is provided a dye-donor element for use according to dye diffusion thermal transfer printing comprising on one side of a support a heat-resistant layer and on a side of the support opposite thereto a donor layer comprising a dye, a binder and a surfactant, said surfactant being a copolymer corresponding to the general formula (I)

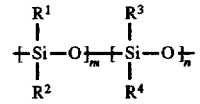

(I)

wherein $R^1$, $R^2$, $R^3$ each independently represent an alkyl group and $R^4$ represents an aralkyl group m and n represent the molar fractions of the respective units in the copolymer and have a value of 0.01 to 0.99 with the provision that the sum of m and n equals 1.

The present invention also provides a method for making an image according to the dye diffusion thermal transfer printing process using a dye donor element as defined above.

DETAILED DESCRIPTION OF THE INVENTION

Preferred surfactants for use in the present invention are those wherein each of $R^1$ to $R^3$ represent a methyl or an ethyl group. Preferably $R^4$ is a 2-phenylpropyl. According to the most preferred embodiment, the groups $R^1$ and $R^3$ represent a methyl group, $R^2$ represents an ethyl group and $R^4$ represents a 2-phenylpropyl group. The nature of the end groups of the copolymer surfactant is not critical for the present invention.

The value of n is preferably 0.1 to 0.5 and the weight average molecular weight of the surfactant copolymer is preferably between 2000 and 500000 g/mol, more preferably between 20000 and 100000 g/mol as determined by GPC in tetrahydrofuran relative to polystyrene standards.

The amount of surfactant per square meter dye layer is preferably between 0.1 and 100 mg, more preferably between 0.5 and 20 mg. The use of this very low amount of surfactant has the advantage that crystallization of dyes during storage of the dye donor element can be prevented.

The coating liquid of the dye layer is preferably based on butanone or a solvent mixture comprising butanone.

The binder for the dye layer preferably comprises a copolymer comprising styrene units and acrylonitrile units, preferentially at least 60% by weight of styrene units and at least 25% by weight of acrylonitrile units binder. The binder copolymer may, of course, comprise other comonomers than styrene units and acrylonitrile units but preferably such that a sufficient number of acrylonitrile units are present. Suitable other comonomers are e.g. butadiene, butyl acrylate, and methyl methacrylate. The binder copolymer preferably has a glass transition temperature of at least 50° C.

It is, of course, possible to use a mixture of a copolymer comprising styrene units and at least 15% by weight of acrylonitrile units with another binder known in the art, but preferably such that said binder copolymer is present in an amount of at least 50% by weight of the total amount of binder. A binder that can be used advantageously in admixture is a toluene sulfonamide formaldehyde condensation product as described in EP 573 080. Such condensation products are e.g. the commercially available under the tradenames Ketjenflex MH and Ketjenflex MS-80 (Akzo, The Netherlands).

The dye layer generally has a thickness of about 0.2 to 5.0 μm, preferably 0.4 to 2.0 μm, and the amount ratio of dye to binder generally ranges from 9:1 to 1:3 weight, preferably from 3:1 to 1:2 by weight.

Any dye or mixture of dyes can be used in the dye layer provided it is easily transferable to the image-receiving layer of the receiver sheet by the action of heat.

Typical and specific examples of dyes for use in thermal dye sublimation transfer have been described in e.g. EP 400,706, EP 209,990, EP 216,483, EP 218,397, EP 227,095, EP 227,096, EP 229,374, EP 235,939, EP 247,737, EP 257,577, EP 257,580, EP 258,856, EP 279,330, EP 279,467, EP 285,665, U.S. Pat. No. 4,743,582, U.S. Pat. No. 4,753,922, U.S. Pat. No. 4,753,,923, U.S. Pat. No. 4,757,046, U.S. Pat. No. 4,769,360, U.S. Pat. No. 4,771,035, JP 84/78,894, JP 84/78,895, JP 84/78,896, JP 84/227,490, JP 84/227,948, JP 85/27,594, JP 85/30,391, JP 85/229,787, JP 85/229,789, JP 85/229,790, JP 85/229,791, JP 85/229,792, JP 85/229,793, JP 85/229,795, JP 86/268,493, JP 86/268,494, JP 85/268,495, and JP 86/284,489.

The coating composition for the dye layer may also contain other additives, such as curing agents, preservatives, dispersing agents, antistatic agents, defoaming agents, viscosity-controlling agents, these and other ingredients having been described more fully in EP 133,011, EP 133,012, EP 111,004, and EP 279,467.

It is highly prefered to use particles protruding from the surface of the dye donor element in said dye layer in order to decrease the sticking behaviour of the dye layer to the reverse side of the dye donor element during storage e.g. in rolled form.

The particles are preferably uniformly distributed throughout the dye layer and have an average particle size exceeding the thickness of the dye layer so as to protrude from the surface of the layer. During the image-wise heating of the dye-donor element they may remain fixed in the dye layer or they may transfer to the image receiving sheet.

The particles preferably have an average particle size ranging from 0.3 to 40 μm, and more preferably from 1.5 to 8 μm. The particles that can be used may be thermo-meltable particles, also called wax particles or they may be solid particles that do not melt during the transfer process.

Wax particles that can be used are any of the water-insoluble thermoplastic wax-like materials of the known six classes of waxes i.e. vegetable waxes, insect waxes, animal waxes, mineral waxes, petroleum waxes, synthetic waxes, as well as the water-insoluble wax-like components that occur individually in these waxes, more particularly long-chain hydrocarbons, saturated, unsaturated, branched, and unbranched fatty acids and alcohols, as well as the ethers and esters of aliphatic monohydric alcohols, with the proviso that the wax melts above 25° C.

Preferentially, the waxes are selected from the group consisting of polyolefin waxes, ester waxes, and amide waxes.

According to another more preferred embodiment the amide wax is an ethylene-bis-stearamide wax such as Ceridust 3910 (trade name) Hoechst, Germany.

For more details about waxes and wax-like thermoplastic materials there can be referred to "The Chemistry and Technology of Waxes", by A. H. Warth, 2nd Ed., 1956, Reinhold Publishing Corporation, New York, U.S.A. and to "Industrial Waxes" Vol. I, by H. Bennett, 1963, Chemical Publishing Company Inc., New York, U.S.A.

The wax is preferably chemically inert towards the other ingredients of the dye layer. Preferably, it does not dissolve together with the binder and the dyes in the solvent or solvent mixture used to form a coating or printing composition that is applied to a support, which may have been provided first with an adhesive or subbing layer.

Sometimes it may be advantageous to combine two or more waxes.

Solid particles that can be used can be selected from the group of inorganic particles and crosslinked polymeric particles. As inorganic particles, silicates such as silica, talc, clay, quartz and carbonates such as e.g. calcium carbonate and dolomite can be used. As crosslinked polymeric particles, e.g. crosslinked polysiloxanes, polymethylsilylsesquioxane and crosslinked polymethylmethacrylate can be used. Among the solid particles, polymethylsilylsesquioxane is especially preferred. These polymethylsesquioxane particles are commercially available under the trade name Tospearl 108, Tospearl 120, Tospearl 130, Tospearl 145 (all from Toshiba-Silicone) and KMP 590 (Shinetsu Silicone).

It is especially useful to combine the use of a surfactant according to the structural formula (I) with polymethylsilylsesquioxane particles since the latter tend to increase the number of pinholes in the absence of said surfactant. These particles are monodisperse. The mean particle diameter is preferably between 0.7 and 7 μm, more preferably between 1.5 and 5 μm. A mixture of particles have a diameter of 2 and 4.5 μm can also be used.

Any material can be used as the support for the dye-donor element provided it is dimensionally stable and capable of withstanding the temperatures involved, up to 400° C. over a period of up to 30 ms, and is yet thin enough to transmit heat applied on one side through to the dye on the other side to effect transfer to the receiver sheet within such short periods, typically from 1 to 10 ms. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive or subbing layer, if desired.

A dye-barrier layer comprising a hydrophilic polymer may also be employed between the support and the dye layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye/binder layer, so that the need for a separate adhesive or subbing layer is avoided. These particular hydrophilic polymers used in a single layer in the dye-donor element thus perform a dual function, hence are referred to as dye-barrier/subbing layers.

Preferably, the reverse side of the dye-donor element has been coated with a heat-resistant layer to prevent the printing head from sticking to the dye-donor element. Such a heat-resistant layer would comprise a lubricating material such as a surface-active agent, a liquid lubricant, a solid lubricant or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid exters. Suitable heat-resistant layers have been described in e.g. EP 138,483, EP 227,090, U.S. Pat. No. 4,567,113, U.S. Pat. No. 4,572,860, U.S. Pat. No. 4,717,711. Preferably the heat-resistant layer comprises a polycarbonate derived from a bis-(hydroxyphenyl)-cycloalkane (diphenol), e.g. 1,1-bis-(4-hydroxyphenyl)-3,3,5-trimethylcyclohexane, as described in EP-A-527 520, as binder and a slipping agent comprising polydimethylsiloxane as lubricant in an amount of 0.1 to 10% by weight of the binder or binder mixture. Other binders for the heat-resistant layer that can be used advantageously for improving the non-stickiness of the dye-donor element in rolled-up state are i.a. cellulose acetate butyrate, cellulose acetate propionate, cellulose nitrate and polyvinylacetal. Suitable heat-resistant layers may also comprise cross-linked polymers for improving the non-stickiness of the dye-donor element in rolled-up state. The slipping agent may be coated in the form of a separate topcoat on top of said heat-resistant layer as described in the above-mentioned EP-A 527 520.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support must be coated with a special layer called dye-image-receiving layer, into which the dye can diffuse more readily. The dye-image-receiving layer may comprise e.g. a polycarbonate, a polyurethane, a polyester, a polyamide, polystyrene-co-acrylonitrile, polycaprolactone, preferably polyvinyl chloride, or mixtures thereof. The dye-image receiving layer may also comprise a heat-cured product of poly(vinyl chloride/co-vinyl acetate/co-vinyl alcohol) and polyisocyanate. Suitable dye-image-receiving layers have been described in e.g. EP 133,011, EP 133,012, EP 144,247, EP 227,094, and EP 228,066.

In order to improve the light-fastness and other stabilities of recorded images UV-absorbers, singlet oxygen quenchers such as HALS-compounds (Hindered Amine Light Stabilizers) and/or antioxidants can be incorporated into the dye-image-receiving layer.

The dye layer of the dye-donor element or the dye-image-receiving layer of the receiver sheet may also contain a releasing agent that aids in separating the dye-donor element from the receiver sheet after transfer. The releasing agents can also be incorporated in a separate layer on at least part of the dye layer and/or of the dye-image-receiving layer. Suitable releasing agents are solid waxes, fluorine- or phosphate-containing surface-active agents and silicone oils. Suitable releasing agents have been described in e.g. EP 133,012, JP 85/19,138, and EP 227,092.

The dye-donor elements according to the invention are used to form a dye transfer image, which process comprises placing a dye frame of the dye-donor element in face-to-face relation with the dye-image-receiving layer of the receiver sheet and image-wise heating preferably from the back of the dye-donor element. The transfer of the dye is accomplished by heating for about several milliseconds at a temperature of 400° C. This process is repeated for the different dye frames of the dye donor element.

In addition to thermal heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat e.g. carbon black.

The following examples illustrate the invention in more detail without, however, limiting the scope thereof.

EXAMPLES

In the examples below, the following dyes are used:

C. I. Disperse Yellow 201 Dye I

Dye II

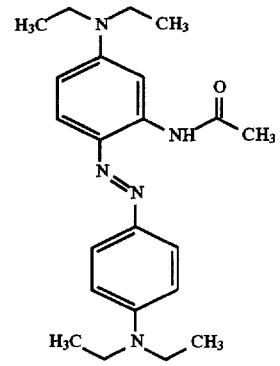

Dye III

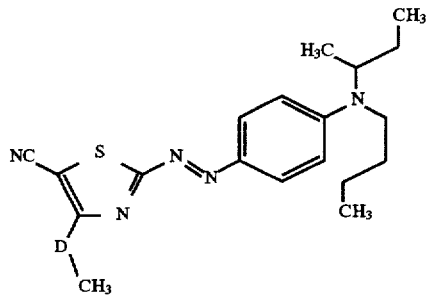

-continued

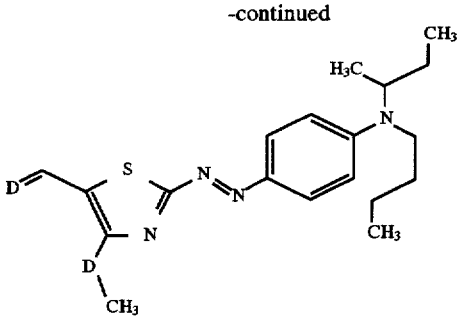

Dye IV

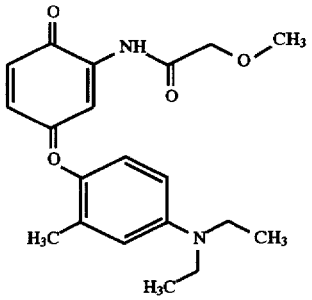

Dye V

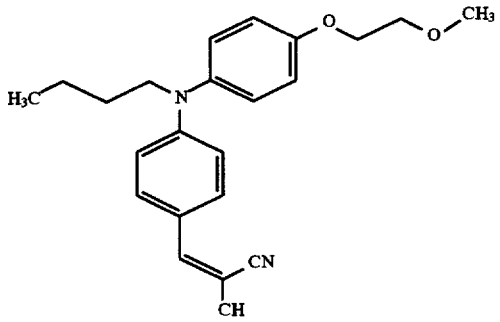

Dye VI

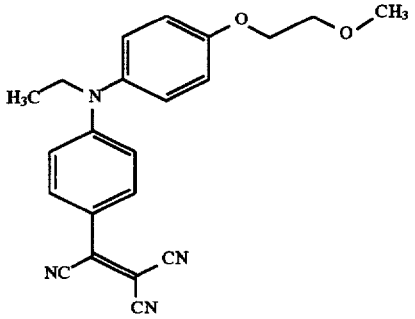

Dye3 VII

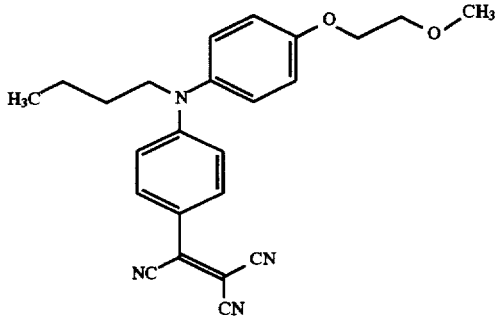

Dye VIII

EXAMPLE 1

Monochrome (black) dye donor element.

Dye-donor elements were obtained by coating a polyethylene terephthalate support (5.7 μm) on one side with a subbing layer comprising a branched aromatic copolyester and a heat resistant layer based on a polycarbonate, having the following repeating units and wherein the number of repeating units (n) is such that the polycarbonate has a relative viscosity of 1.3 as measured at 0.5% solution in dichloromethane, Tegoglide 410 (Goldschmidt), zinc stearate and talc.

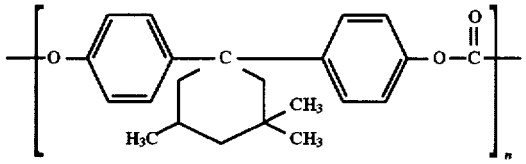

On the other side of said dye-donor elements, a subbing layer comprising a branched aromatic copolyester was applied. On top of said subbing layer, a dye layer was coated from the dye coating mixtures comprising 8.8% Luran™ 388S (BASF), 4.4% dye I, 3.2% dye II, 4.5% dye III, 1.2% dye IV, 5.95% dye V, 0.5% Tospearl™ 145 (Toshiba Silicone), 0.5% Tospearl™ 120 (Toshiba Silicone) and a surfactant as mentioned in Table I. The percentages are weight percentages in the coating solution and the solvent is butanone. The dye layer was coated by means of a gravure coater at a wet thickness of 8.5 μm.

TABLE I

| Comparative examples | Surfactant Type | Surfactant Concentration (%) | Pinholes |
|---|---|---|---|
| C1 | — | — | Bad |
| C2 | I | 0.025 | Moderate |
| C3 (*) | II | 0.05 | Moderate |
| C4 (*) | II | 0.1 | Moderate |
| C5 (*) | II | 0.5 | Moderate |
| C6 (*) | III | 0.1 | Moderate |
| C7 (*) | III | 0.2 | Moderate |
| C8 (*) | IV | 0.5 | Moderate |
| C9 (*) | IV | 1 | Moderate |
| C10 (*) | V | 0.5 | Moderate |
| C11 (*) | VI | 0.1 | Moderate |
| C12 (*) | VI | 0.2 | Moderate |
| C13 (*) | VII | 0.025 | Moderate |
| C14 (*) | VII | 0.3 | Bad |
| Example E1 (*) | VIII | 0.025 | Good |
| Example E2 | VIII | 0.7 | Good (**) |
| Example E3 | VIII | 0.02 | Good |

(*) The coating solution for the dye layer further comprises 0.025% Ceridust ™ 3910 (Hoechst).

(**) Although no pinholes were observed, the uniformity of the coating was inferior to the uniformity of examples E1 and E3.

Surfactant I Ceridust ™ 3910, ethylenebisstearamide wax (Hoechst)

Surfactant II L050 ™, a polyether modified polydimethylsiloxane (Wacker)

Surfactant III AR200 ™, a polymethylphenylsiloxane surfactant (Wacker)

Surfactant IV Efka ™ 772, a fluorinated polyacrylate surfactant (Efka)

Surfactant V Additol ™ CL480, a polyacrylate surfactant (Hoechst)

Surfactant VI Schwego Fluor ™ 8036, a fluor containing polymeric surfactant (Schwegmann)

Surfactant VII Fluorad ™ FC 431 (3M)

Surfactant VIII $-[-Si(C_2H_5)-O-]_m-[-Si(CH_2-CH(CH_3)-C_6H_5)-O-]_n-$ with m/n=3 and a weight average molecular weight of 37000 as determined by GPC relative to Polystyrene Standards.

As can be seen from table I, the surfactant of the present invention performs better than the surfactants of the prior art. Moreover, no crystallization of the dyes was observed after storage for 7 days at 45° C./70% relative humidity and clear uniform images were obtained after printing on a receiving element suitable for use in combination with the donor elements of the present invention.

EXAMPLE 2

Three color dye donor element.

A three color dye donor element was prepared as in example 1, except that 3 separate dye frames were coated sequentially on the support.

The yellow dye frame was obtained by casting a coating solution comprising 10.5% Luran™ 388S, 6.3% dye I, 6.3% dye VI, 0.53% Tospearl™ 120 (Toshiba Silicone) and 0.025% of surfactant VIII butanone at 7 μm wet thickness.

The magenta dye frame was obtained by casing a coating solution comprising 10.5% Luran™ 388S, 4.2% dye VII, 7.35% dye VIII, 0.52% Tospearl™ 120 (Toshiba SIlicone) and 0.025% of surfactant VIII in butanone at 7 μm wet thickness.

The cyan dye frame was obtained by casting a coating solution comprising 10.5% Luran™ 388S, 8.4% dye IX, 4.2% dye X 0.25% Tospearl 120 (Toshiba Silicone) and 0.025% of surfactant VIII in butanone at 7 μm wet thickness. A uniform coating of the dye layers was obtained and uniform images can be produced without pinholes >10 μm when multicolor prints were made on a receiving element suitable for use in combination with the donor elements of the present invention. Without the use of surfactant VIII, coating defects were found in the magenta and cyan frame and pinholes were found in the yellow frame.

We claim:

1. Dye-donor element for use according to dye diffusion thermal transfer printing comprising on one side of a support a heat-resistant layer and on a side of the support opposite thereto a donor layer comprising a dye, a binder and a surfactant, said surfactant being a copolymer corresponding to the general formula (I)

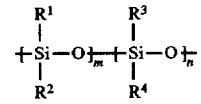

(I)

wherein $R^1$, $R^2$ and $R^3$ each independently represent an alkyl group $R^4$ represents an aralkyl group m and n represent the molar fractions of the respective units in the copolymer and have a value of 0.01 to 0.99 with the provision that the sum of m and n equals 1.

2. Dye donor element according to claim 1 wherein each of $R^1$, $R^2$ and $R^3$ independently represents a methyl group or an ethyl group.

3. Dye donor element according to claim 2 wherein $R^4$ is 2-phenylpropyl.

4. Dye donor element according to claim 1, wherein n is between 0.1 and 0.5.

5. Dye donor element according to claim 1 wherein the weight average molecular weight of said surfactant is between 1,000 and 500,000 g/mol.

6. Dye donor element according to claim 1 wherein said surfactant is present in an amount 0.1 mg to 100 mg/m$^2$.

7. Dye donor element according to claim 1 wherein the dye layer further comprises particles protruding from the surface of said dye donor element.

8. Dye donor element according to claim 7 wherein said particles are polymethylsilylsesquioxane particles.

9. Method for making an image comprising the steps of:

bringing a dye layer provided on a support of a dye donor element in face-to-face relationship with an image receiving layer provided on a support of an image receiving element, said dye layer comprising a dye, a binder and a surfactant, said surfactant being a copolymer corresponding to the formula (I)

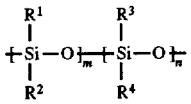

(I)

wherein $R^1$, $R^2$ and $R^3$ each independently represent an alkyl group $R^4$ represents an aralkyl group m and n represent the molar fractions of the respective units in the copolymer and have a value of 0.01 to 0.99 with the provision that the sum of m and n equals 1;

image-wise heating so as to cause image-wise transfer of dye from said dye layer to said image receiving layer.

10. Method for making an image according to claim 9 wherein said dye layer further comprises particles protruding from the surface of said dye donor element.

* * * * *

UNITED STATES PATENT AND TRADEMARK OFFICE

CERTIFICATE OF CORRECTION

PATENT NO. : 5,674,804

DATED : October 7, 1997

INVENTOR(S) : Steen et al.

It is certified that error appears in the above-identified patent and that said Letters Patent is hereby corrected as shown below:

Column 5, line 23, "exters" should read --esters--;

Column 7, line 15,

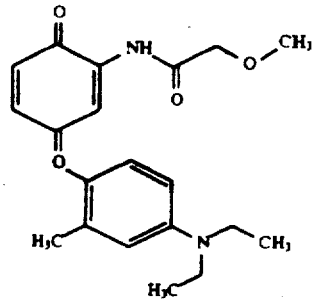

Dye V should read

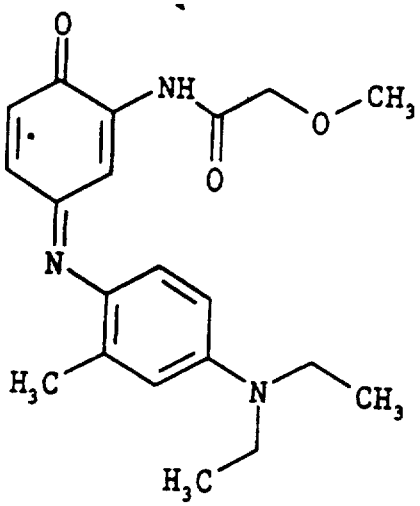

Dye V

UNITED STATES PATENT AND TRADEMARK OFFICE

CERTIFICATE OF CORRECTION

PATENT NO. : 5,674,804

DATED : October 7, 1997

INVENTOR(S) : Steen et al.

It is certified that error appears in the above-identified patent and that said Letters Patent is hereby corrected as shown below:

Column 7, line 37, (last line of Dye VI), "CH" should read --CN--.

Signed and Sealed this

Second Day of June, 1998

*Attest:*

*Attesting Officer*

BRUCE LEHMAN

*Commissioner of Patents and Trademarks*